US007911430B2

(12) United States Patent
Fujine

(10) Patent No.: US 7,911,430 B2
(45) Date of Patent: Mar. 22, 2011

(54) LIQUID CRYSTAL DISPLAY

(75) Inventor: Toshiyuki Fujine, Sakura (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 411 days.

(21) Appl. No.: 10/544,231

(22) PCT Filed: Jan. 30, 2004

(86) PCT No.: PCT/JP2004/000966
§ 371 (c)(1),
(2), (4) Date: Aug. 2, 2005

(87) PCT Pub. No.: WO2004/070697
PCT Pub. Date: Aug. 19, 2004

(65) Prior Publication Data

US 2006/0158410 A1 Jul. 20, 2006

(30) Foreign Application Priority Data

Feb. 3, 2003 (JP) ..... 2003-025636

(51) Int. Cl.
*G09G 3/36* (2006.01)

(52) U.S. Cl. ..... 345/89; 345/690

(58) Field of Classification Search ..... 345/87–104
See application file for complete search history.

(56) References Cited

U.S. PATENT DOCUMENTS 6,115,423 A 9/2000 Shen et al.
6,124,842 A * 9/2000 Mizutome et al. ..... 345/698
6,396,469 B1 5/2002 Miwa et al.
6,750,837 B1 6/2004 Kudoh
6,771,243 B2 8/2004 Hirohata et al.
6,927,766 B2 * 8/2005 Tagawa et al. ..... 345/204
(Continued)

FOREIGN PATENT DOCUMENTS

CN 1402211 A 3/2003
(Continued)

OTHER PUBLICATIONS

"Degradation of Quality of Moving Images Displayed on HOld Type Displays and Its Improving Method", Taiichiro Kurita, IEICE General Conference Lecture Papers 1999 pp. 207-208.

*Primary Examiner* — Quan-Zhen Wang
*Assistant Examiner* — Calvin C Ma
(74) *Attorney, Agent, or Firm* — Birch, Stewart, Kolasch & Birch, LLP

(57) ABSTRACT

A liquid crystal display has an LCD controller, a microcomputer, and a storage section. The LCD controller is capable of setting up an image display period for performing display based on input image data and a black display period for performing display based on black display data, within one field period. The microcomputer switches the mode of the LCD controller between an impulse-drive mode having the image display period and the black display period within the one field period, and a hold drive mode having only the image display period. The storage section stores sets of reference gradation voltage data that are previously specified. A reference gradation voltage, which is generated at a reference gradation voltage generation section and used for driving the liquid crystal display panel, is variable according to the mode. Thus, it is possible to realize the liquid crystal display that can suppress changes in gamma characteristics so as to prevent deterioration of display quality even when the mode is switched.

6 Claims, 15 Drawing Sheets

U.S. PATENT DOCUMENTS

| | | | | |
|---|---|---|---|---|
| 6,937,224 | B1 | 8/2005 | Miyachi | |
| 7,084,861 | B2 * | 8/2006 | Iisaka | 345/204 |
| 7,133,015 | B1 | 11/2006 | Yoshida et al. | |
| 7,151,572 | B2 | 12/2006 | Shirahama et al. | |
| 7,161,576 | B2 * | 1/2007 | Kawabe et al. | 345/99 |
| 7,173,599 | B2 | 2/2007 | Nishimura | |
| 7,218,305 | B2 * | 5/2007 | Nose | 345/102 |
| 7,265,741 | B2 | 9/2007 | Kumamoto et al. | |
| 2001/0003448 | A1 | 6/2001 | Nose et al. | |
| 2001/0024199 | A1 | 9/2001 | Hughes et al. | |
| 2001/0055007 | A1 | 12/2001 | Miura et al. | |
| 2002/0003522 | A1 | 1/2002 | Baba et al. | |
| 2002/0044116 | A1 | 4/2002 | Tagawa et al. | |
| 2002/0057238 | A1 | 5/2002 | Nitta et al. | |
| 2002/0067332 | A1 | 6/2002 | Hirakata et al. | |
| 2002/0067436 | A1 | 6/2002 | Shirahama et al. | |
| 2002/0075249 | A1 | 6/2002 | Kubota et al. | |
| 2002/0097252 | A1 | 7/2002 | Hirohata | |
| 2002/0105494 | A1 | 8/2002 | Lin et al. | |
| 2002/0154088 | A1 | 10/2002 | Nishimura | |
| 2002/0157094 | A1 | 10/2002 | Saito et al. | |
| 2003/0001983 | A1 | 1/2003 | Nose | |
| 2003/0011610 | A1 | 1/2003 | Kitsutaka | |
| 2003/0058229 | A1 | 3/2003 | Kawabe et al. | |
| 2003/0142118 | A1 | 7/2003 | Funamoto et al. | |
| 2004/0012556 | A1 | 1/2004 | Yong et al. | |
| 2004/0041750 | A1 | 3/2004 | Abe | |
| 2004/0141094 | A1 | 7/2004 | Kumamoto et al. | |
| 2006/0139289 | A1 | 6/2006 | Yoshida et al. | |
| 2006/0279523 | A1 | 12/2006 | Nitta et al. | |
| 2007/0085794 | A1 | 4/2007 | Kawabe et al. | |
| 2007/0139315 | A1 | 6/2007 | Abe | |

FOREIGN PATENT DOCUMENTS

| | | | |
|---|---|---|---|
| EP | 1 061 499 | A2 | 12/2000 |
| EP | 1 061 499 | A3 | 12/2000 |
| EP | 1 091 341 | A2 | 4/2001 |
| EP | 1 197 944 | A2 | 4/2002 |
| EP | 1 471 489 | A1 | 10/2004 |
| JP | 05-303078 | A | 11/1993 |
| JP | 06-149177 | A | 5/1994 |
| JP | 6-236165 | A | 8/1994 |
| JP | 7-66992 | A | 3/1995 |
| JP | 8-313927 | A | 11/1996 |
| JP | 9-127917 | | 5/1997 |
| JP | 09-281943 | A | 10/1997 |
| JP | 9-325715 | | 12/1997 |
| JP | 10-97227 | A | 4/1998 |
| JP | 10-108086 | A | 4/1998 |
| JP | 10-333648 | A | 12/1998 |
| JP | 11-109921 | | 4/1999 |
| JP | 11-202286 | A | 7/1999 |
| JP | 11-296145 | A | 10/1999 |
| JP | 11-341393 | A | 12/1999 |
| JP | 2000-013707 | A | 1/2000 |
| JP | 2000-020206 | A | 1/2000 |
| JP | 2000-206492 | A | 7/2000 |
| JP | 2000-293142 | A | 10/2000 |
| JP | 2000-321551 | A | 11/2000 |
| JP | 2001-060078 | | 3/2001 |
| JP | 2001-108962 | A | 4/2001 |
| JP | 2001-125547 | A | 5/2001 |
| JP | 2001-159871 | A | 6/2001 |
| JP | 2001-184034 | A | 7/2001 |
| JP | 2001-201763 | A | 7/2001 |
| JP | 2001-210122 | A | 8/2001 |
| JP | 2001-251567 | A | 9/2001 |
| JP | 2001-282174 | A | 10/2001 |
| JP | 2001-296838 | A | 10/2001 |
| JP | 2002-23137 | | 1/2002 |
| JP | 2002-40390 | | 2/2002 |
| JP | 2002-41002 | | 2/2002 |
| JP | 2002-055657 | A | 2/2002 |
| JP | 2002-72969 | A | 3/2002 |
| JP | 2002-123223 | | 4/2002 |
| JP | 2002-152690 | A | 5/2002 |
| JP | 2002-156950 | A | 5/2002 |
| JP | 2002-215111 | A | 7/2002 |
| JP | 2002-244627 | A | 8/2002 |
| JP | 2002-287700 | A | 10/2002 |
| JP | 2002-305695 | A | 10/2002 |
| JP | 2002-311413 | A | 10/2002 |
| JP | 2002-318569 | | 10/2002 |
| JP | 2002-323876 | A | 11/2002 |
| JP | 2002-365163 | A | 12/2002 |
| JP | 2003-66918 | A | 3/2003 |
| JP | 2003-280617 | A | 10/2003 |
| JP | 2004-533020 | A | 10/2004 |
| KR | 1020020029619 | A | 4/2002 |
| KR | 1020020082790 | A | 10/2002 |
| WO | WO 01/13167 | A1 | 2/2001 |
| WO | WO 02/067238 | A2 | 8/2002 |
| WO | WO 02/104005 | A1 | 12/2002 |
| WO | WO 03/063121 | A1 | 7/2003 |

* cited by examiner

| | | REFERENCE GRADATIONS | | | | | | | | |
|---|---|---|---|---|---|---|---|---|---|---|
| | | 0 | 32 | 64 | 96 | 128 | 160 | 192 | 224 | 255 |
| VOLTAGE DATA | HOLD-TYPE DISPLAY | V0 | V32 | V64 | V96 | V128 | V160 | V192 | V224 | V225 |
| | IMPULSE-TYPE DISPLAY | V0 | V32 | V64 | V96 | V128 | V160 | V192 | V224 | V225 |

GAMMA CHARACTERISTICS OF LIQUID CRYSTAL DISPLAY

FIG. 9

| | | | REFERENCE GRADATIONS | | | | | | | | |
|---|---|---|---|---|---|---|---|---|---|---|---|
| | | | 0 | 32 | 64 | 96 | 128 | 160 | 192 | 224 | 255 |
| VOLTAGE DATA | BELOW 10°C | HOLD-TYPE DISPLAY | V0 | V32 | V64 | V96 | V128 | V160 | V192 | V224 | V225 |
| | | IMPULSE-TYPE DISPLAY | V0 | V32 | V64 | V96 | V128 | V160 | V192 | V224 | V225 |
| | 10~20°C | HOLD-TYPE DISPLAY | V0 | V32 | V64 | V96 | V128 | V160 | V192 | V224 | V225 |
| | | IMPULSE-TYPE DISPLAY | V0 | V32 | V64 | V96 | V128 | V160 | V192 | V224 | V225 |
| | 20~30°C | HOLD-TYPE DISPLAY | V0 | V32 | V64 | V96 | V128 | V160 | V192 | V224 | V225 |
| | | IMPULSE-TYPE DISPLAY | V0 | V32 | V64 | V96 | V128 | V160 | V192 | V224 | V225 |
| | 30~40°C | HOLD-TYPE DISPLAY | V0 | V32 | V64 | V96 | V128 | V160 | V192 | V224 | V225 |
| | | IMPULSE-TYPE DISPLAY | V0 | V32 | V64 | V96 | V128 | V160 | V192 | V224 | V225 |
| | 40~50°C | HOLD-TYPE DISPLAY | V0 | V32 | V64 | V96 | V128 | V160 | V192 | V224 | V225 |
| | | IMPULSE-TYPE DISPLAY | V0 | V32 | V64 | V96 | V128 | V160 | V192 | V224 | V225 |
| | 50~60°C | HOLD-TYPE DISPLAY | V0 | V32 | V64 | V96 | V128 | V160 | V192 | V224 | V225 |
| | | IMPULSE-TYPE DISPLAY | V0 | V32 | V64 | V96 | V128 | V160 | V192 | V224 | V225 |

V-T CHARACTERISTICS OF LIQUID CRYSTAL DISPLAY PANEL AND VOLTAGES

GAMMA CHARACTERISTICS OF LIQUID CRYSTAL DISPLAY

GAMMA CHARACTERISTICS OF LIQUID CRYSTAL DISPLAY

GAMMA CHARACTERISTICS OF LIQUID CRYSTAL DISPLAY

LIQUID CRYSTAL DISPLAY

TECHNICAL FIELD

The present invention relates to a liquid crystal display which displays images by using a liquid crystal display panel. More particularly, the present invention relates to a liquid crystal display capable of improving deterioration of display quality of moving images, which is caused by response characteristics of the liquid crystal display panel.

BACKGROUND ART

In these years, there have been needs for reductions in weight and thickness of personal computers and TV sets. According to such needs, flat-panel displays such as liquid crystal displays (LCD) have been developed, as substitutes for cathode-ray tubes (CRT).

An LCD is a display that applies an electric field to a liquid crystal layer having anisotropic permittivity (anisotropic dielectric constant), the liquid crystal layer being interposed between two substrates. By adjusting the electric field, the LCD controls a volume of light passing through the substrates so as to obtain desired image signals. The LCD is well known among other flat-panel displays convenient for carriage. Especially, a thin film transistor (TFT) LCD utilizing a TFT as a switching element is predominantly used.

With reference to FIGS. 10 through 14, a conventional liquid crystal display is described. FIG. 10 is a block diagram illustrating a schematic structure of the conventional liquid crystal display. FIG. 10 shows an LCD controller 1, a liquid crystal display panel 2, a signal line drive circuit 3, a scan line drive circuit 4, a reference gradation voltage generation section 5, a backlight 6, and a backlight driving inverter circuit 7.

Image data is input in the LCD controller 1, as gradation data D11 and synchronous data D12. The gradation data D11 is RGB signals, for example. The synchronous data D12 includes a vertical synchronizing signal, a horizontal synchronizing signal, a data enable signal (DE), a clock and others. Based on the input gradation data D11 and synchronous data D12, the LCD controller 1 generates not only gradation data D13 and a signal-side control signal D14 to be output to the signal line drive circuit 3, but also a scan line control signal D15 to be output to the scan line drive circuit 4. With this arrangement, the LCD controller 1 controls image display on the liquid crystal display panel 2.

With reference to FIG. 11, a structure of the liquid crystal display panel 2 (active matrix type LCD) is described. The liquid crystal display panel 2 has a first and a second glass substrates (not shown). Over the first glass substrate, thin film transistors (TFT) 11 are provided near respective intersections of n scan lines G1 to Gn and m signal lines S1 to Sm. The TFT 11 is a nonlinear element (switching element).

Gate lines for the TFTs 11 are connected to the scan lines G1 to Gn. Source electrodes are connected to the signal lines S1 to Sm, and drain electrodes are connected to pixel electrodes. The second glass substrate is disposed so as to face the first glass substrate, and common electrodes are formed all over the surface of the glass substrate, using transparent electrodes made of ITO and the like. Each of the common electrodes is connected to a common electrode drive circuit 12, which defines an electric potential. Liquid crystal 13 is interposed between the common electrodes and the pixel electrodes formed on the first glass.

The scan lines G1 to Gn and the signal lines S1 to Sm are connected to the scan line drive circuit 4 and the signal line drive circuit 3, respectively. The scan line drive circuit 4 applies a high voltage to n scan lines G1 to Gn sequentially, so as to carry out scanning and activate the TFT 11 connected to each of the scan lines G1 to Gn. While the scan line drive circuit 4 scans the scan lines G1 to Gn, the signal line drive circuit 3 outputs gradation voltages corresponding to image data to any of m signal lines S1 to Sm. With this, the gradation voltage is written into the pixel electrodes through the activated TFTs 11. Then, a difference in electric potentials is generated between the common electrodes set at a certain potential and the pixel electrodes where the gradation voltage is applied. With the difference, the volume of light transmission is adjusted.

The backlight 6 disposed at the back side of the liquid crystal display panel 2 is driven by the inverter circuit 7, so as to emit light with a certain level of brightness. Therefore, according to the aforesaid operating principles of the liquid crystal display panel 2, the volume of transmitted light emitted from the backlight 6 is controlled, so that a desirable image display is realized.

The reference gradation voltage generation section 5 illustrated in FIG. 10 supplies the signal line drive circuit 3 with a reference gradation voltage. A reference gradation voltage is applied to the liquid crystal display panel 2, in accordance with a gradation level of image data. FIG. 12 is an explanatory view expressing one example of the relationship between the transmittance of the liquid crystal and the applied voltage. In order to carry out image display with the liquid crystal having the characteristics expressed in FIG. 12, a reference gradation voltage is defined so that the relationship between the gradation level of the image data and the transmittance draws a curve of gamma 2.2 as plotted in FIG. 13, for example. With reference to FIG. 12, one-eighth of the maximum reference gradation voltage is defined as a reference gradation, for example. The rest of the gradation voltages are generated by dividing the adjacent reference gradation voltages. More specifically, all display gradation voltages are defined using divided resistors.

FIG. 14 is an explanatory view illustrating signal waveforms output from the scan line drive circuit 4 and the signal line drive circuit 3 to the scan lines and the signal lines, respectively, in the conventional liquid crystal display. In FIG. 14, the time is set on the abscissa axis. VG1 to VGn are signals output sequentially to n scan lines, by applying a high electric potential (data electric potential) to a single scan line at a time. VD is a signal waveform output to a single signal line, and Vcom is a signal waveform applied to common electrodes. In an example illustrated in FIG. 14, the VD is a signal that changes in signal intensity corresponding to each image data, and the Vcom is a signal that maintains a certain value and does not change with time.

The conventional liquid crystal display and its driving method are described above. When movie display is carried out on the conventional liquid crystal display, display quality deteriorates, for example, after-image emerges. The cause of this problem is a slow response of liquid crystal material. When a gradation of input image data changes, the liquid crystal material cannot respond to the change within one field period. Thus, it is assumed that a few field periods are required to respond. To solve this problem, studies about liquid crystal materials and others have been currently implemented.

Not only the delay of the optical response time, but also an LCD display system itself are pointed out as causes of motion blur in movie display. This issue is brought up at the convention of the institute of electronics information and communication engineers in 1999 (SC-8-1, pp. 207-208), for example. FIGS. 15 and 16 illustrate results of comparing the response time of display light between a CRT and an LCD, in terms of one pixel. FIG. 15 plots the response time of the CRT, and FIG. 16 plots the response time of the LCD. As shown in FIG. 15, the CRT is a so-called impulse-type display, which illuminates for only a few milliseconds after an electronic beam hits fluorescent material on the surface of a tube. As shown in FIG. 16, the LCD is a so-called hold-type display, which holds display light during one field period from the completion of writing data into a pixel to the start of writing next data.

When movie display is carried out in the hold-type display, LCD, a currently displayed image and a previously displayed image are viewed as an overlapped image. The overlap is caused by time integration of visual perception and tracking characteristics of the sight line in the direction of movement. Thus, the motion blur occurs. For preventing the motion blur, several techniques have been proposed as follows. Image data and black data are repeatedly written in the liquid crystal display panel within one field period. Accordingly, a period for carrying out black display (black display period) is set up between one field image display and the next field image display. Thus, a hold time for the display light, that is, an image display period is cut down. In this manner, the display status with the hold-type drive is caused to resemble the display with the impulse-type drive such as the CRT.

FIG. 17 illustrates one example of a so-called black-writing-type liquid crystal display. After writing input image data in one field into a liquid crystal display panel sequentially, black display data is written into all over the screen at the same time, so that the black display over the entire screen is carried out for a certain period of time. With reference to another example illustrated in FIG. 18, black display data is written into the scan lines sequentially, so that the black display is carried out in part of the screen for a certain period of time. Accordingly, the image display period is shortened compared to the one in the conventional hold-type display (disclosed in Japanese Laid-Open Patent Publication No. 127917/1997 and 109921/1999, Tokukaihei 9-127917 and 11-109921). Such a liquid crystal display that has display elements and a shutter is disclosed in Tokukaihei 9-325715, for example. In the liquid crystal display disclosed in this publication, the display elements transform electric image signals to image-display light while continuing the transforming operation for a certain display hold period. Also, the shutter limits the display hold period to a certain time within one field period, in synchronism with the vertical synchronization of image signals.

Furthermore, the following is proposed in Tokukai 2002-123223 and 2002-318569. Only when moving images are displayed on the liquid crystal display panel, the black display is carried out in at least a part of the screen for a certain period of time, so that the impulse-type display is carried out. As a result, the motion blur emerged in movie display can be restrained. In static display, the hold-type display is carried out without setting the black display period. Thus, deterioration of display quality due to flicker and others is prevented.

However, the relationship between the display gradation and the display brightness, that is, so-called gamma characteristics differ between the impulse display mode shown in FIGS. 17 and 18 and the normal hold display mode shown in FIG. 19. The impulse-type display is carried out by producing the black display in at least part of the screen for a certain period of time. In FIG. 20, for example, the full line plots gamma characteristic in the hold display mode. The dotted line plots gamma characteristics when the motion blur is prevented in the impulse display mode shown in FIG. 18. That is, the black display period is inserted into one field period, so that the image display period is shortened. With this, it is recognized that display brightness in a low gradation tends to decrease. Therefore, image-display characteristics vary between movie display with the method shown in FIGS. 17 and 18 and static display with the method shown in FIG. 19. Thus, display quality significantly deteriorates.

In FIG. 21, the full line plots changes in display brightness with time in the hold display mode. The dotted line in FIG. 21 plots changes in display brightness with time when the motion blur is prevented in the impulse display mode illustrated in FIG. 18. As FIG. 21 clearly shows, the ratio in attained brightness between the methods in low gradation display is different from the ratio in attained brightness between the methods in high gradation display. Therefore, it is considered that the different characteristics in display gradation and display brightness (gamma characteristics) between the display methods come from the differences between the response characteristics of the liquid crystal in the low-gradation display and the response characteristics of the liquid crystal in the high-gradation display.

When image display is carried out with the impulse-type display illustrated in FIG. 18, due to the temperature dependency of the liquid crystal as shown in FIG. 22, display brightness in a low gradation tends to decrease as the temperature of the liquid crystal display panel becomes low. That is, gamma characteristics change depending on temperatures of the liquid crystal display panel, so that display quality varies (deteriorates).

DISCLOSURE OF INVENTION

An object of the present invention is to provide a liquid crystal display, which can prevent deterioration of display quality by suppressing variations in gamma characteristics, even when a mode for driving a liquid crystal display panel is switched between an impulse drive mode and a hold drive mode.

To attain the foregoing object, the liquid crystal display of the present invention displaying, using a liquid crystal display panel, an image responsive to input image data, includes driving means for driving the liquid crystal display panel in either an impulse drive mode or a hold drive mode, (i) in the impulse drive mode an image display period for performing display according to the input image data, and a monochrome display period for performing display according to previously-specified certain monochrome display data being generated within an input image data rewriting period (e.g. within one field period) for writing in each pixel of the liquid crystal display panel, while (ii) in the hold drive mode display according to the input image data being always performed within the rewriting period without setting the monochrome display period; switching means for switching between the modes for driving the liquid crystal display panel by the driving means; and means for varying a gradation voltage to be applied to the liquid crystal display panel corresponding to the input image data in accordance with a mode for driving the liquid crystal display panel.

In addition to the arrangement, it is preferable in the primary invention that the means for varying the gradation voltage varies a reference gradation voltage for driving the liquid crystal display panel.

Further, in addition to the arrangement, it is preferable that the liquid crystal display panel further includes a storage section storing sets of reference gradation voltage data previously specified.

In addition to the arrangement, it is preferable that the liquid crystal display panel further includes means for detecting a temperature in the liquid crystal display; and means for varying a gradation voltage to be applied to the liquid crystal display panel in accordance with the input image data and the detected temperature in the display.

Further, in addition to the arrangement, it is preferable that the switching means switches between the modes for driving the liquid crystal display panel, in accordance with a user's instruction, or in accordance with a result of detecting an amount of movement of the input image data or a result of detecting a status of connection with a device for inputting the input image data.

In the liquid crystal display of the present invention, in accordance with a selected drive mode (impulse drive mode or hold drive mode), a gradation voltage to be applied to the liquid crystal display panel varies corresponding to input image data. Therefore, it is possible to prevent variations in gamma characteristics, which is caused by differences in response speed of the liquid crystal between display gradations, when certain monochrome display is carried out. Thus, it is possible to prevent deterioration of display quality, which occurs when the impulse display mode and the hold display mode are switched.

According to a mode for driving the liquid crystal display panel, the driving means varies a reference gradation voltage itself for driving the liquid crystal display panel. Thus, display capability of the liquid crystal display panel can be maintained and high-quality display can be realized. Further, gamma characteristics due to the temperature dependency of the liquid crystal can be also suppressed, so that high-quality display can be always achieved.

For a fuller understanding of the nature and advantages of the invention, reference should be made to the ensuing detailed description taken in conjunction with the accompanying drawings.

BRIEF DESCRIPTION OF DRAWINGS

FIG. 9 is a schematic explanatory view showing specific examples of the reference gradation voltage data storage section in the liquid crystal display, according to the second embodiment of the present invention.

BEST MODE FOR CARRYING OUT THE INVENTION

The following more specifically describes the present invention through examples and comparative examples. However, the present invention is not limited by the examples and comparative examples.

Figure 1:
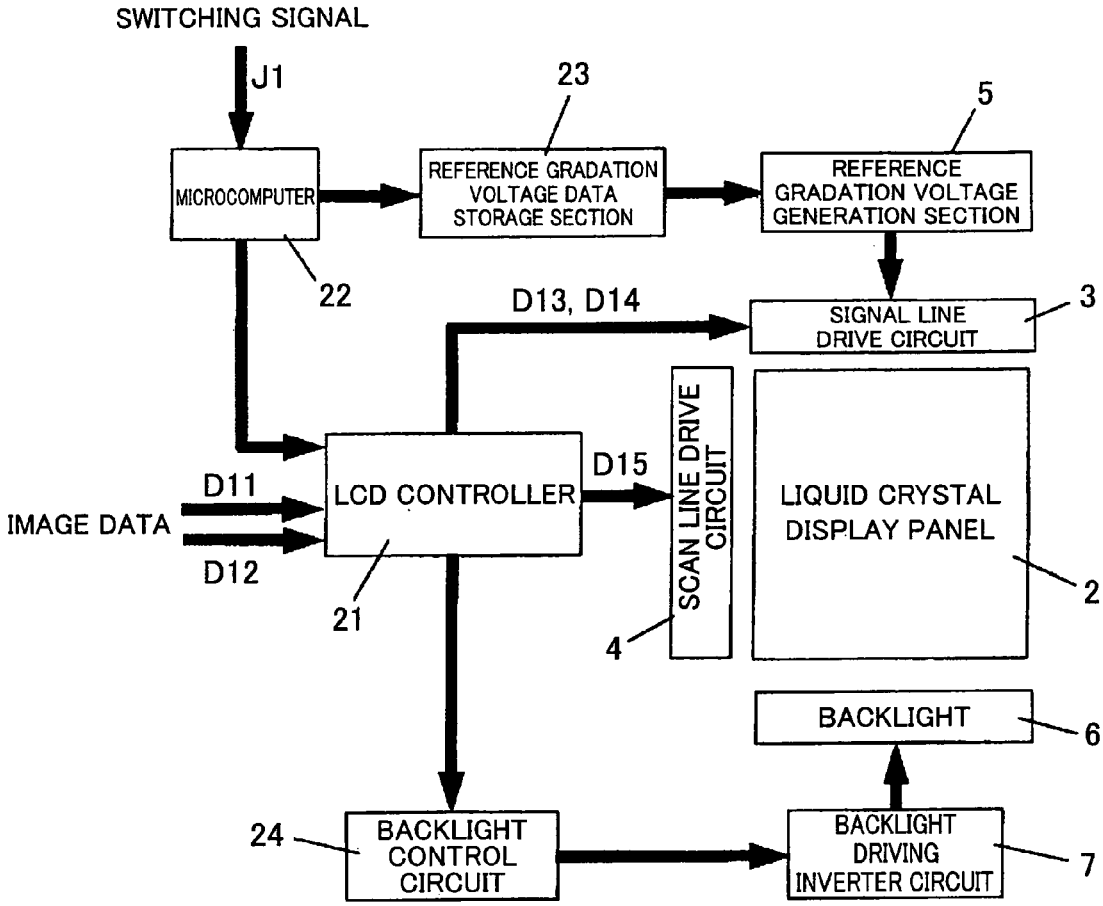
FIG. 1 is a block diagram illustrating a schematic structure of the liquid crystal display according to the first embodiment of the present invention.
Figures 2, 3:
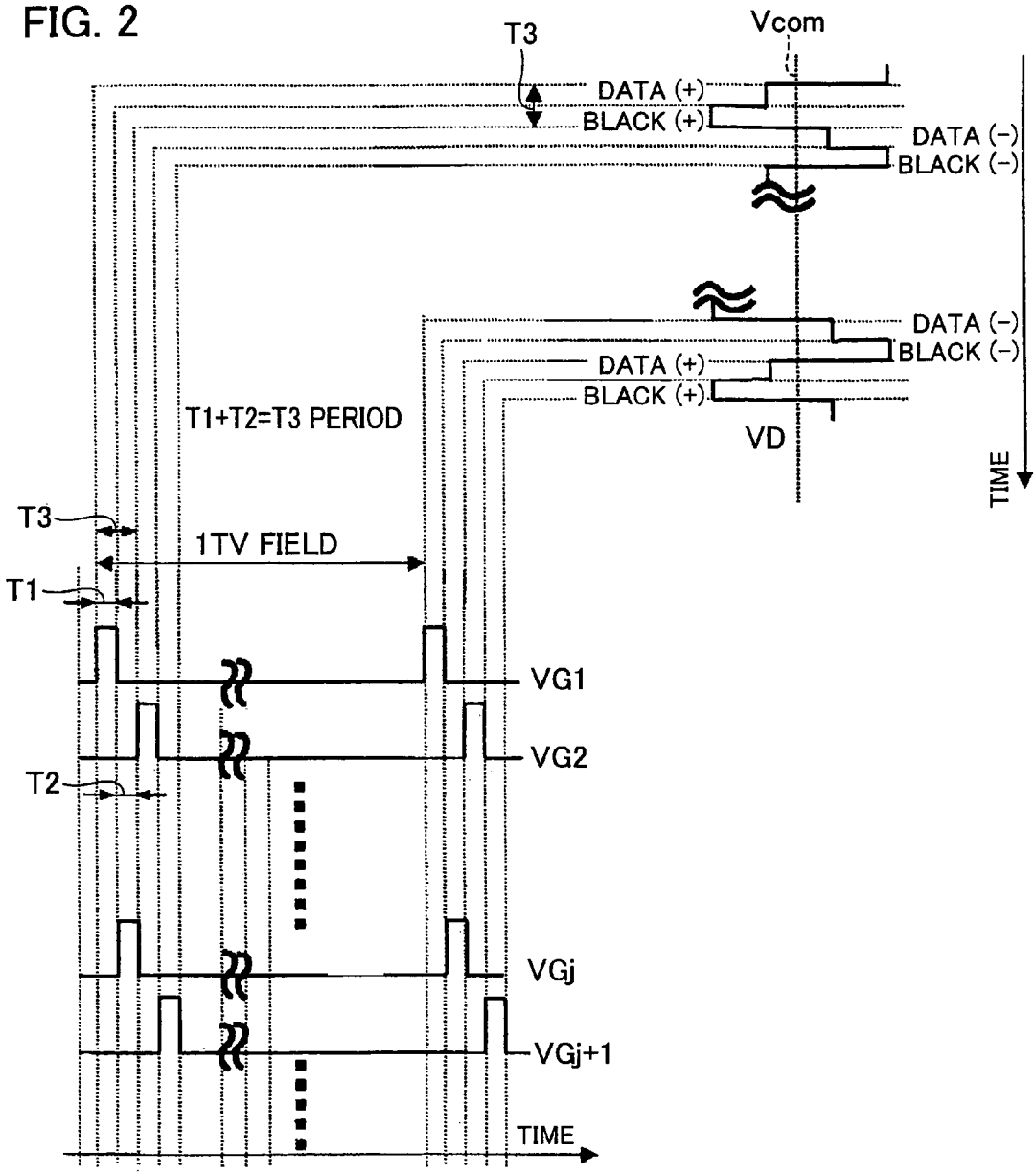
FIG. 2 is an explanatory diagram illustrating one example of drive signal waveforms in the liquid crystal display panel performing the impulse-type display, according to the first embodiment of the present invention.
FIG. 3 is a schematic explanatory view showing specific examples of the reference gradation voltage data storage section in the liquid crystal display, according to the first embodiment of the present invention.

With reference to FIGS. 1 through 7, a first embodiment of the present invention is described below. The same numbers are used for the same parts with the conventional examples, and their explanations are omitted. FIG. 1 is a block diagram illustrating a schematic structure of the liquid crystal display of the present embodiment. FIG. 2 is an explanatory diagram illustrating one example of drive signal waveforms in the impulse-type display in the liquid crystal display of the present embodiment. FIG. 3 is a schematic explanatory view showing specific examples of the reference gradation voltage data storage section in the liquid crystal display of the present embodiment.

Figure 4:
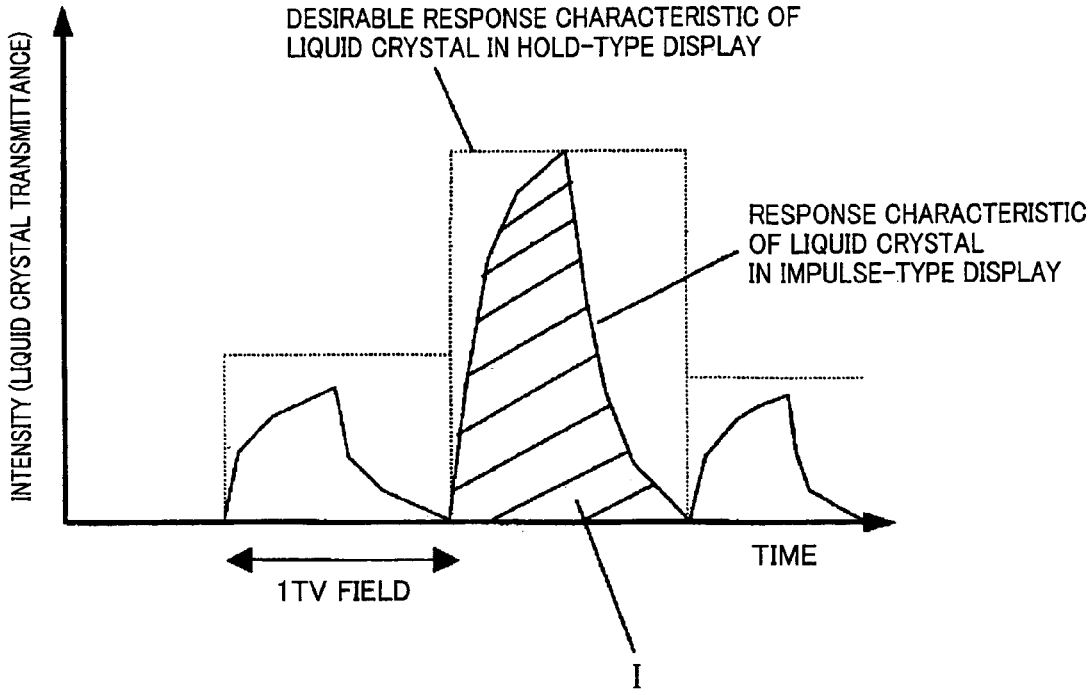
FIG. 4 is a schematic explanatory view expressing response characteristics of the liquid crystal in the liquid crystal display, according to the first embodiment of the present invention.
Figure 5:
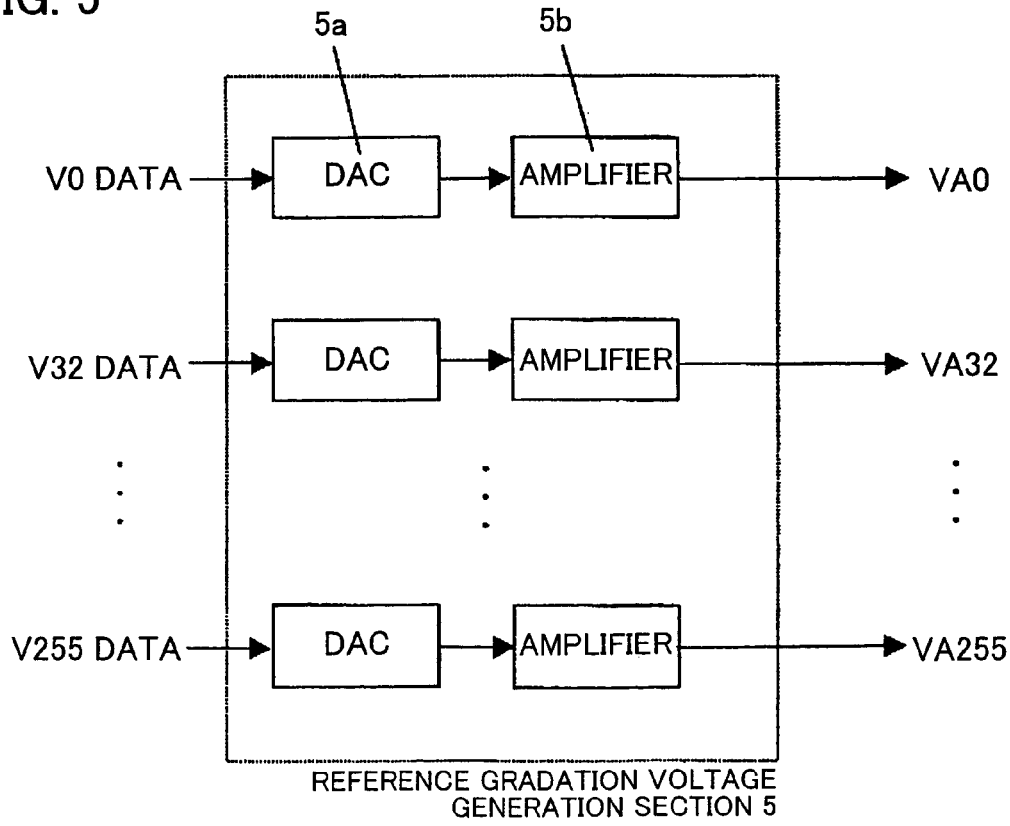
FIG. 5 is a block diagram illustrating a schematic structure of the reference gradation voltage generation section in the liquid crystal display, according to the first embodiment of the present invention.
Figure 6:
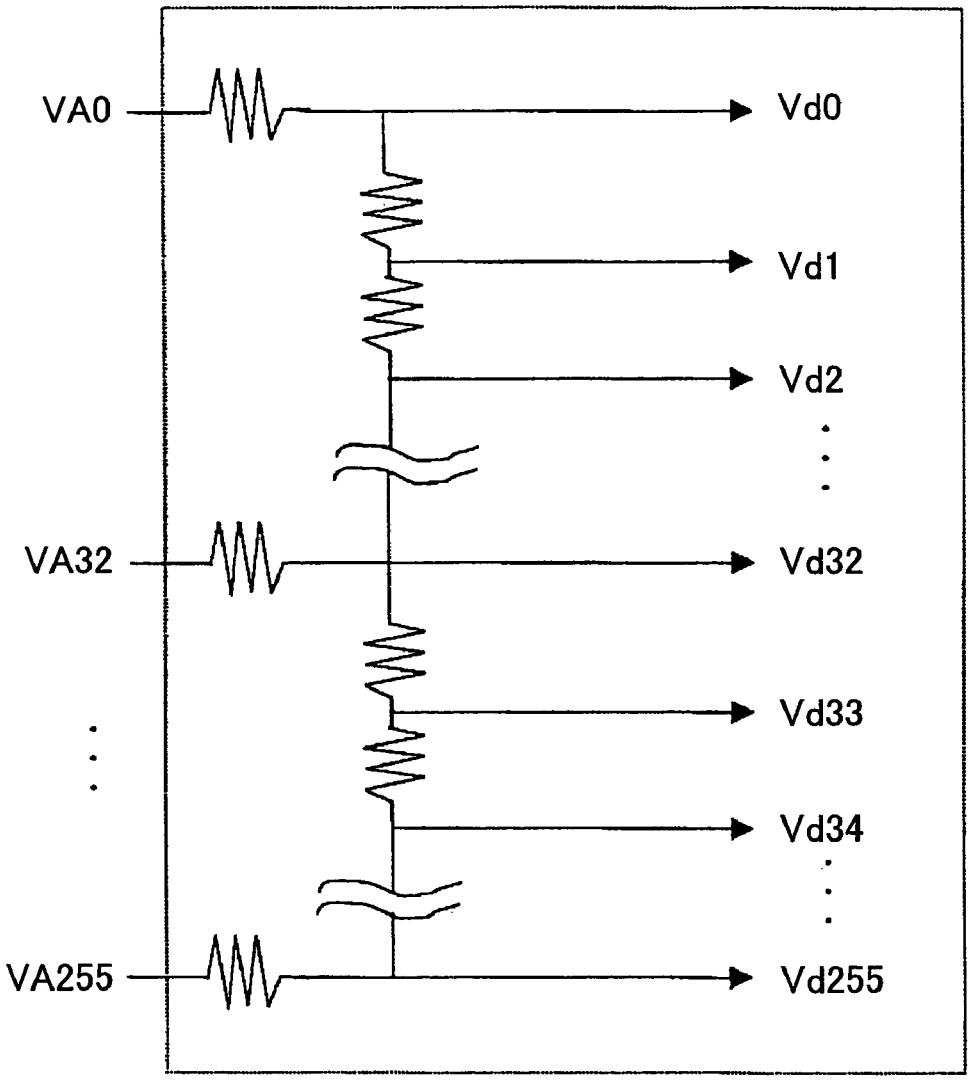
FIG. 6 is a circuit diagram schematically illustrating substantial parts of the signal line drive circuit in the liquid crystal display, according to the first embodiment of the present invention.
Figure 7:
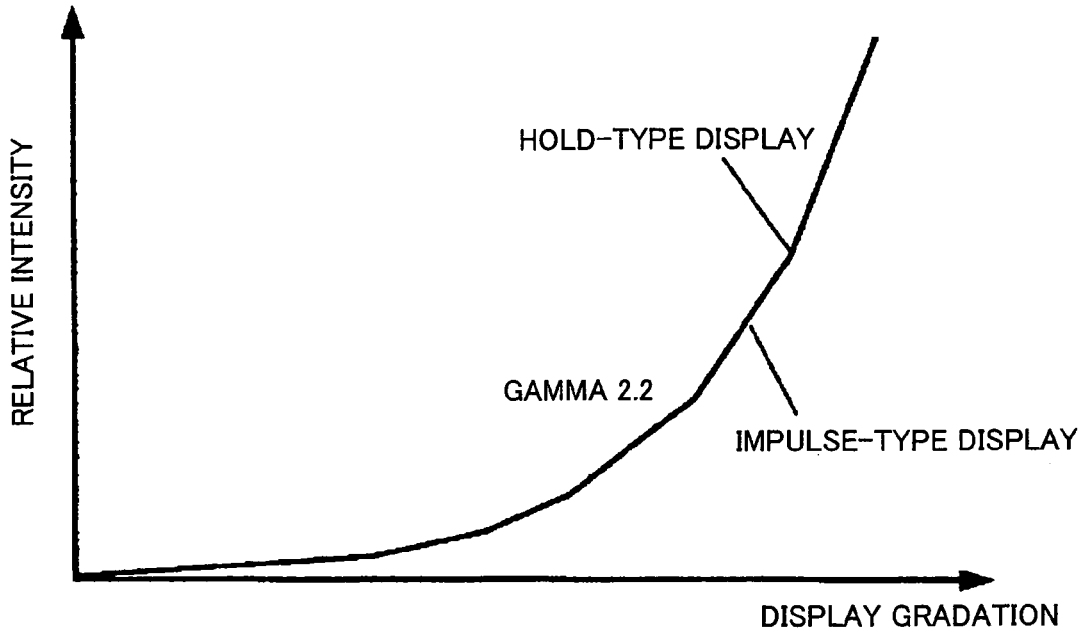
FIG. 7 is a schematic explanatory view expressing gamma characteristics of the liquid crystal display performing the hold-type display and the impulse-type display, according to the first embodiment of the present invention.

FIG. 4 is a schematic explanatory view expressing response characteristics of the liquid crystal in the liquid crystal display of the present embodiment. FIG. 5 is a block diagram illustrating a schematic structure of the reference gradation voltage generation section in the liquid crystal display of the present embodiment. FIG. 6 is a circuit diagram illustrating a schematic structure of primary parts of the signal line drive circuit in the liquid crystal display of the present embodiment. FIG. 7 is a schematic explanatory view expressing gamma characteristics in the hold display mode and the impulse display mode in the liquid crystal display according to the present embodiment.

The liquid crystal display of the present embodiment has a microcomputer 22, a reference gradation voltage data storage section 23, and a backlight control circuit 24 as illustrated in FIG. 1. The microcomputer 22 is supplied with a switching signal J1. The switching signal J1 is used for switching between the hold-type display displaying input image data throughout one field period (e.g. for 16.7 msec when the vertical display cycle is 60 Hz) and the impulse-type display generating, in one field period, a monochrome display period in which display based on certain monochrome display data is carried out. The reference gradation voltage data storage section 23 is, for example, a ROM which stores a plurality of values of reference gradation voltages generated at the reference gradation voltage generation section 5 for each of the display methods (in the impulse-type display or the hold-type display). The backlight control circuit 24 controls lighting of the backlight 6 in synchronism with the writing of monochrome display data.

The microcomputer 22 executes programs stored on storage such as memory (not shown), thereby giving instructions to the LCD controller 21 (drive means) to perform the display methods, and performing control operations so that values of reference gradation voltages corresponding to the display methods can be read out from the reference gradation voltage data storage section (means for varying gradation voltages) 23. Therefore, it is possible to allow a microcomputer (computer), which is capable of controlling the LCD controller (drive means) 21 and the reference gradation voltage data storage section 23, to act as the microcomputer 22, by causing the microcomputer to execute the aforesaid methods. The programs executed by the computer are, for instance, distributed in the form of storage mediums storing the programs, or distributed through various wired or wireless channels.

The switching signal J1 is generated in accordance with user's preference which is manually input using a remote controller (not shown) and others. The display methods may be also automatically switched between the movie display and the static display. Based on the switching signal J1, the microcomputer 22 instructs the LCD controller 21 to insert black display data/perform display, thereby changing whether to carry out the impulse-type display or the hold-type display on the liquid crystal panel 2.

The switching signal J1 can be generated through a circuit receiving an instruction by a user's manual input (e.g. light-receptive spot on the remote controller (not shown)), or a circuit detecting an automatic switching trigger (e.g. a circuit detecting the amount of movement of input image data or a circuit detecting a status of connection with another device). Also, based on the switching signal J1 from such a circuit, the microcomputer 22 may control the LCD controller 21 and the reference gradation voltage data storage section 23. Alternatively, the microcomputer 22 may control these members 21 and 23, referring to user's instructions or an automatic switching trigger.

The circuit that receives the user's instructions or the microcomputer 22 may receive, as the user's instructions, instructions defining whether or not to carry out the impulse-type display, or determine whether or not the impulse-display is carried out, in response to specified instructions defining in advance the relevance of whether or not to carry out the impulse-display. The specified instructions include an instruction for selecting an input image source or for setting an image display mode. Further, the microcomputer 22 or the circuit that detects an automatic switching trigger may define whether or not to carry out the impulse-type display, based on the amount of movement detected in the input image data, or based on the presence or absence of the state of connection with a computer (not shown) that mainly generates static images. Note that, the circuit receiving instructions or the circuit detecting triggers generates the switching signal J1 so as to define whether or not to carry out the impulse-type display. Also, the microcomputer 22 controls the members 21 and 23 so as to define whether or not to carry out the impulse-type display.

Regardless of the methods for defining whether or not to carry out the impulse-type display, as illustrated in FIG. 2, when performing the impulse-type display, scanning signals supplied from the scan line drive circuit 4 to the scan lines G1 to Gn on the liquid crystal display panel 2 have an image data select period T1 and a black display select period T2 within one field period. During the image data select period T1, gradation voltages corresponding to image data are written into the pixel electrodes. During the black display select period T2, a voltage for carrying out the black display is written into the pixel electrode. Gradation voltages corresponding to image data and a voltage for carrying out the black display are alternately output to the signal lines S1 to Sm.

The black display select period T2 is set as about a half of the conventional scan line select period T3 described with reference to FIG. 14. The black display is carried out in a scan line locating above or below with a distance for several lines from a scan line, selected in the image data select period T1. A voltage corresponding to the black display is applied to the signal lines S1 to Sm during the black display select period T2, so that the black display can be carried out in each of the scan lines. A line to which black data is written and a line to which image data is written are selected by suitable control of the scan line drive circuit 4 by the LCD controller 21. As a result, the lines can be scanned sequentially, while the distance for several lines between the image-data written line and the black-data written line is maintained.

The black display data is inserted between sets of image data for respective fields, inside the LCD controller 21. As to one line, a half of the period for selecting a single line is used for supplying image data to the signal line driver circuit 3, and the rest of the period is used for supplying the black display data to the signal line drive circuit 3. Accordingly, the impulse-type display can be realized with 50 percent of the impulse-ratio (ratio of the image display period in one image display cycle). Note that, FIG. 2 illustrates one example of using the liquid crystal display panel in a normally white mode. However, the present invention is not limited to this, and it is obvious that the liquid crystal display panel in a normally black mode can be also used.

Figure 14:
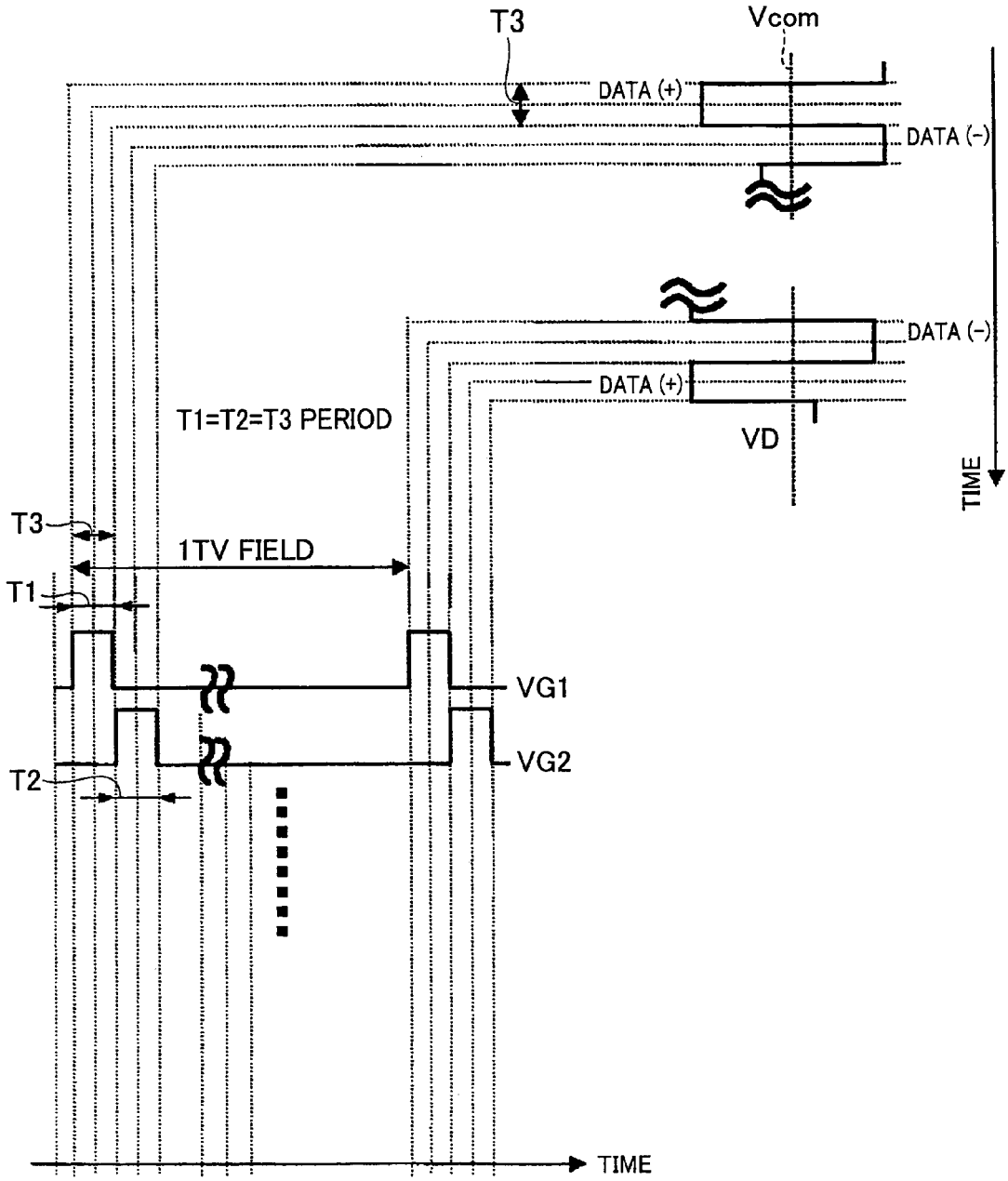
FIG. 14 is an explanatory view illustrating one example of drive signal waveforms in the liquid crystal display panel performing the hold-type display.
Figure 15:
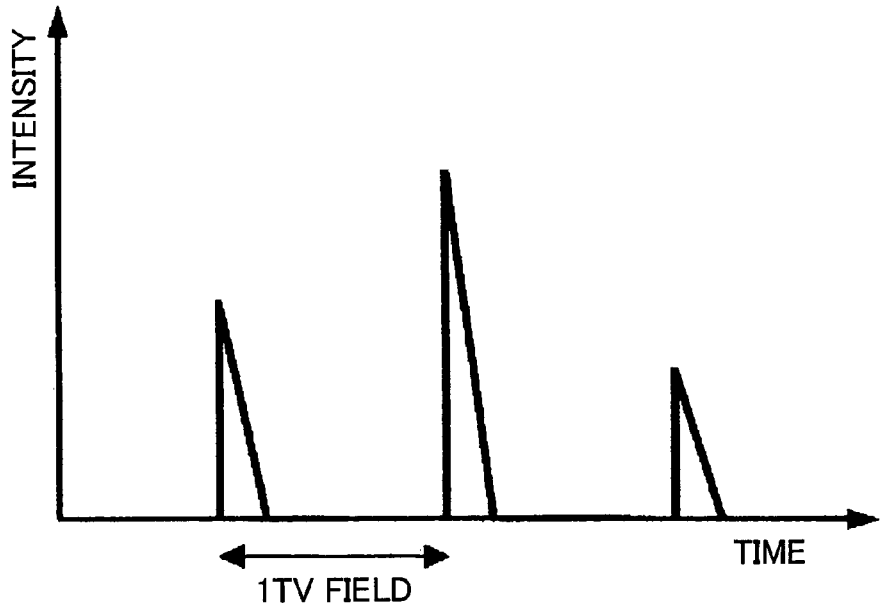
FIG. 15 is a schematic explanatory view expressing time response of the display light in the CRT.
Figure 16:
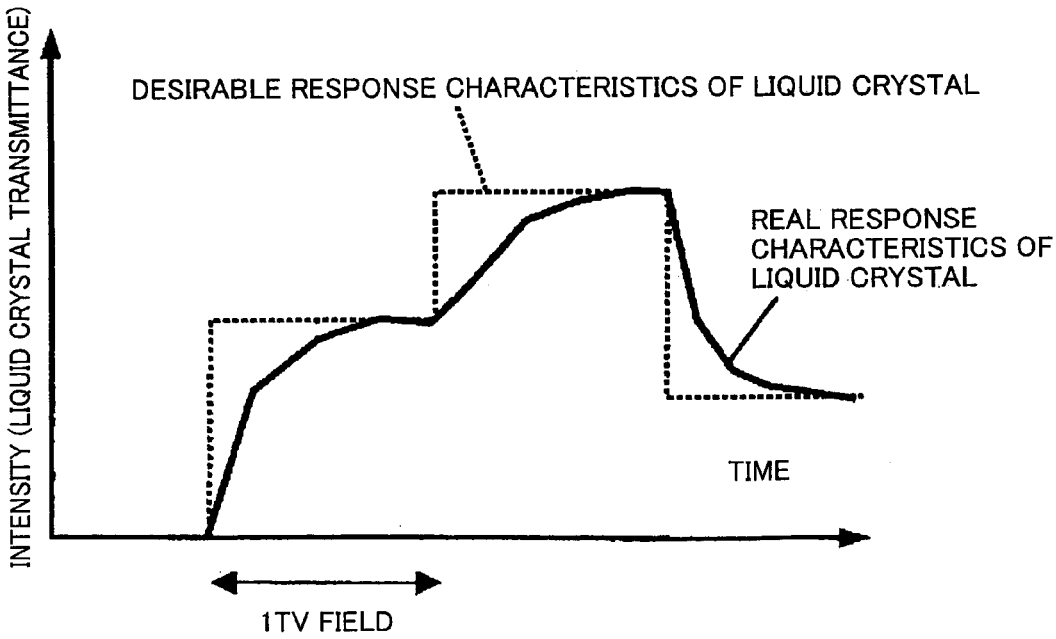
FIG. 16 is a schematic explanatory view expressing time response of the display light in the LCD.

On the other hand, for the hold-type display having no prevention for the motion blur in static display, the conventional example illustrated in FIG. 14 is applied in similar fashion. The LCD controller 21 controls the scan line drive circuit 4 not only to supply the signal line drive circuit 3 with input image data, but also to perform line-scanning in each field circle. Thus, the normal hold-type display can be realized with 100 percent of the impulse ratio.

Next, the reference gradation voltage generation section 5 supplies the signal line drive circuit 3 with reference gradation voltages, based on the reference gradation voltage data stored in the reference gradation voltage data storage section 23. As shown in FIG. 3, the reference gradation voltage data storage section 23 stores sets of reference gradation voltage data corresponding to the hold display mode and the impulse display mode, respectively, onto separate regions of a ROM. One of these sets of reference gradation voltage data is selected and output to the reference gradation voltage generation section 5, according to an instruction from the microcomputer 22. The sets of reference gradation voltage data to be stored on the reference gradation voltage data storage section 23 are set as follows.

Figure 12:
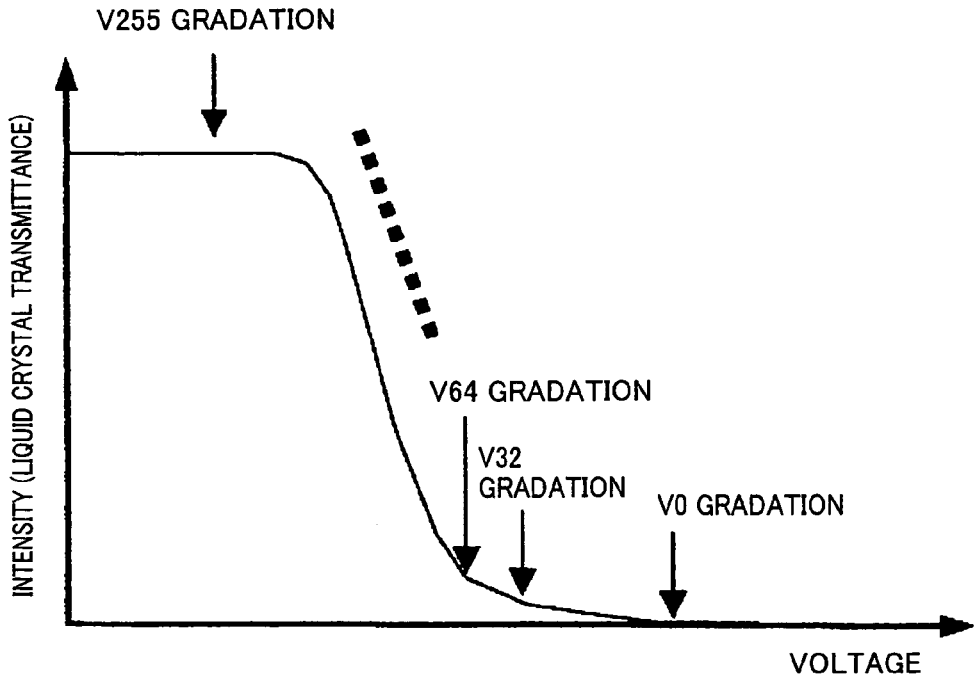
FIG. 12 is an explanatory view expressing one example of the relationships between the transmittance and the applied voltage of the liquid crystal.
Figure 13:
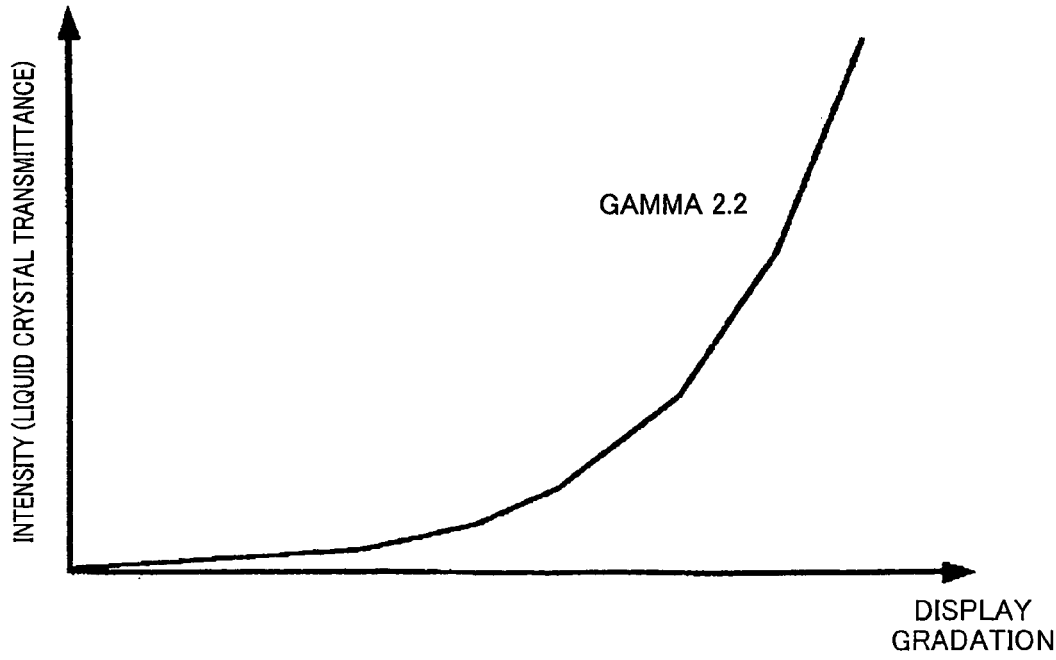
FIG. 13 is a schematic explanatory view expressing gamma characteristics in the liquid crystal display.

First, reference gradation voltage data corresponding to the hold display mode is set so that the relationship between the display gradation and the display brightness (liquid crystal transmittance) forms gamma 2.2, in accordance with a so-called V-T curve as plotted in FIG. 12. As an example, when the number of display signal levels, that is, the number of displayed data is 256 gradations for eight bits, voltage data V0, V32 . . . , V255 corresponding to 0, 32, 64, 96, 128, 160, 192, 224, 255 gradations have been set or stored. For other gradations but the stored reference gradations, the reference gradation voltages are linearly divided by resistors, so as to obtain voltages for all gradations to be applied to the liquid crystal display panel 2.

On the other hand, for the impulse-type display, reference gradation voltage data is not determined directly based on the V-T curve plotted in FIG. 12. The reference gradation voltage data is determined by working out the relationship between the intensity integral I and the voltage T applied to the liquid crystal within one field period, while display brightness (transmittance) changes with time during the impulse display mode as plotted in FIG. 4. The intensity integral I changes according to the response speed of the liquid crystal. The response speed of the liquid crystal changes according to a display gradation. Therefore, in the case of the impulse-type display, the relationship between the applied voltage and the liquid crystal transmittance (intensity) shown in FIG. 12 cannot be held. That is, it is not possible to realize desirable gradation display with the gradation voltage for the hold-type display, which is determined in accordance with the V-T curve in FIG. 12.

As countermeasures, for the impulse-type display, a new relationship between the intensity integral I and the applied voltage within one field period is measured. Then, the reference gradation voltage data, which is different from the one in the hold-type display, is set so that the relationship between the display gradation and the display brightness (liquid crystal transmittance) can form, for example, the relationship of gamma 2.2. As an example, when the number of display signal levels, that is, the number of displayed data is 256 gradations for eight bits, voltage data V0, V32 . . . , V255 corresponding to 0, 32, 64, 96, 128, 160, 192, 224, 255 gradations are set or stored. For other gradations but the stored reference gradations, the reference gradation voltages are linearly divided by resistors, so that voltages for all gradations to be applied to the liquid crystal display panel 2 are obtained.

As illustrated in FIG. 5, the reference gradation voltage generation section 5 causes a DA converter 5*a* to convert digital data V0, V32, . . . , V255 obtained from the reference gradation voltage data storage section 23 into analog data. Then, the reference gradation voltage generation section 5 causes an amplifier 5*b* to amplify and adjust the reference gradation voltages VA0, VA32, . . . , VA255 as appropriate, thereby supplying them to the signal line drive circuit 3 including a source driver and others. As illustrated in FIG. 6, in the signal line drive circuit 3, input terminals of the reference gradation voltages VA0, VA32 . . . VA255 are connected each other by divided resistors. Voltages for all gradations corresponding to image data are generated, so that display in accordance with image data for eight bits is performed.

The above description is about a case that gradation voltages corresponding to nine reference gradations for each 32-step gradation, 0, 32, 64, 96, 128, 160, 192, 224, 255 are generated and other gradation voltages are produced with divided resistances. However, regardless of the example, it is obvious that the above description can be applied for a case that gradation voltages corresponding to reference gradations for each 16-step gradation are generated, for example.

As described above, based on the switching signal J1 supplied to the microcomputer 22, one of the sets of reference gradation voltage data for the hold-type display and the impulse-type display, both of which are stored in the reference gradation voltage data storage section 23, is read out into the reference gradation voltage generation section 5. Then, based on the reference gradation voltage data thus read out, a gradation voltage to be applied to the liquid crystal display panel 2 is determined, corresponding to each gradation level of the input image data.

As shown in FIG. 7, regardless of the hold display mode or the impulse display mode, it is possible to prevent changes in gamma characteristics caused by differences in response speed of the liquid crystal in each display gradation due to the insertion of the black display. Thus, a desirable display condition can be maintained, so that deterioration of display quality due to changes in gamma characteristics can be prevented.

For simplicity of the explanation, in the above embodiment, the hold display mode in which a ratio of image display period in one field period (impulse ratio) is 100 percent and the impulse display mode in which the ratio is 50 percent are selected in an alternate manner. However, the present invention is not limited to this. Obviously, it is possible to control switching between a plurality of different impulse ratios by setting a suitable black display period. Thus, the arrangement allows a reference gradation voltage for driving the liquid crystal display panel to be varied, in accordance with each impulse ratio.

In the present embodiment, in accordance with the impulse ratio, a reference gradation voltage for driving the liquid crystal display panel is varied. As a result, the gamma characteristics are always maintained at certain levels. However, the present invention is not limited to this. As an example, a gradation conversion section is provided in a stage prior to the LCD controller 21. Then, a gradation level of image data is converted, so that a gradation voltage to be applied to the liquid crystal display panel 2 is varied according to the input image data. In this case, the image data supplied to the LCD controller 21 is actually compressed in bits, so that the display performance deteriorates due to the gradation conversion.

On the contrary, as presented in the present embodiment, a reference gradation voltage to be supplied to the signal line drive circuit 3 is adjusted, so that changes in gamma characteristics can be restrained with the display performance for eight bits maintained. Thus, even when subtle gradation changes are displayed, high-quality display is realized without stripe discontinuity in the display.

Figure 8:
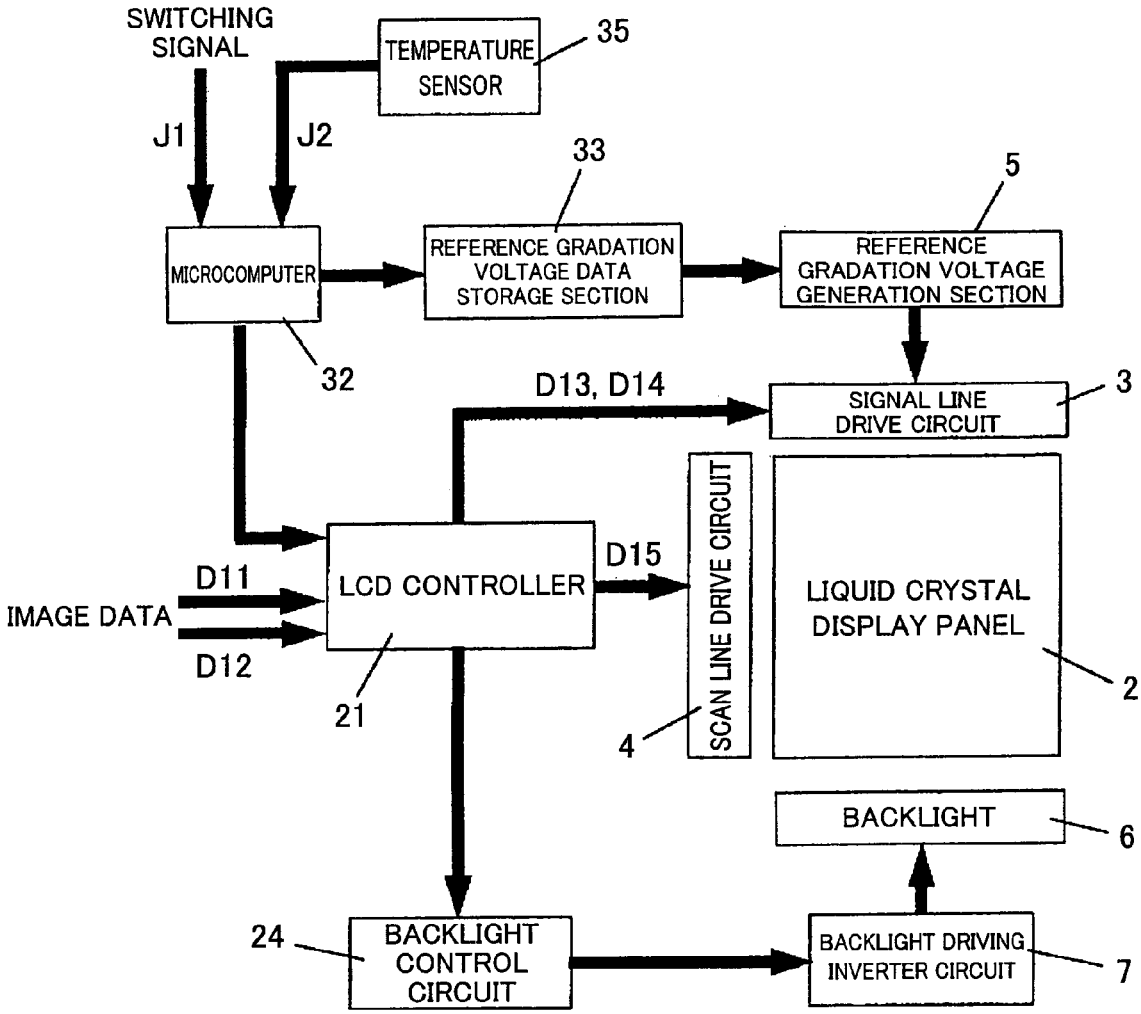
FIG. 8 is a block diagram illustrating a schematic structure of the liquid crystal display, according to the second embodiment of the present invention.
Figure 10:
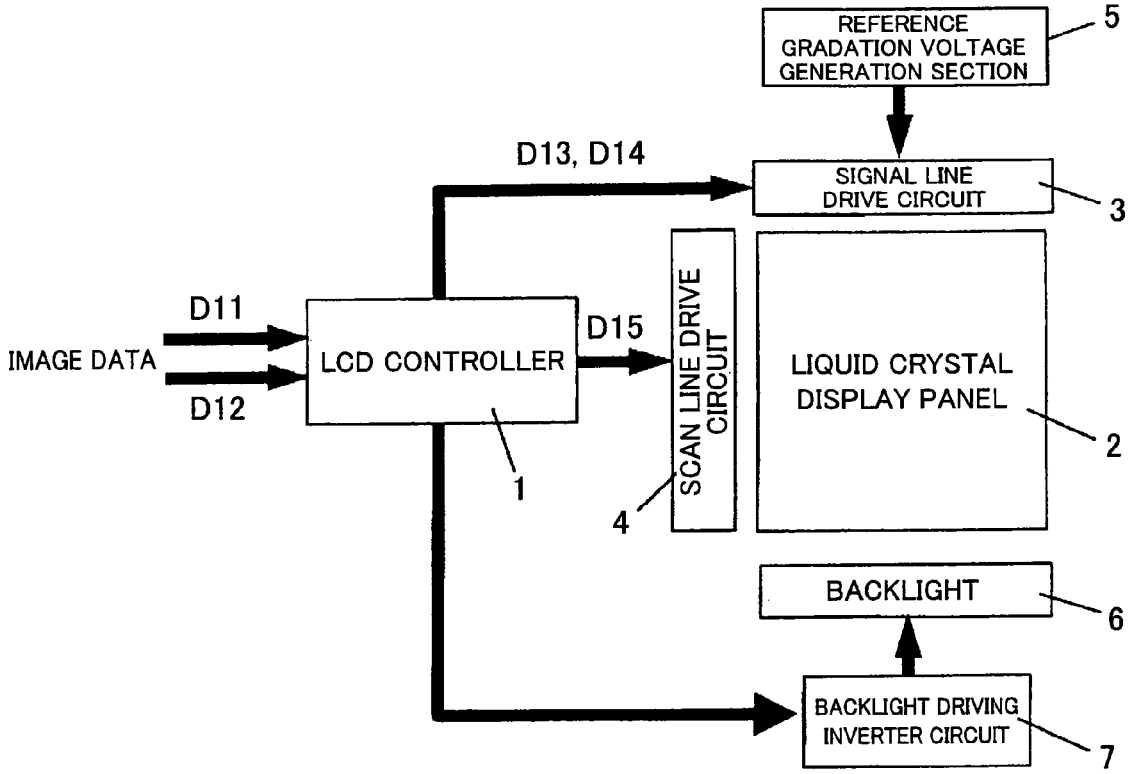
FIG. 10 is a block diagram illustrating a schematic structure of the conventional liquid crystal display.
Figure 11:
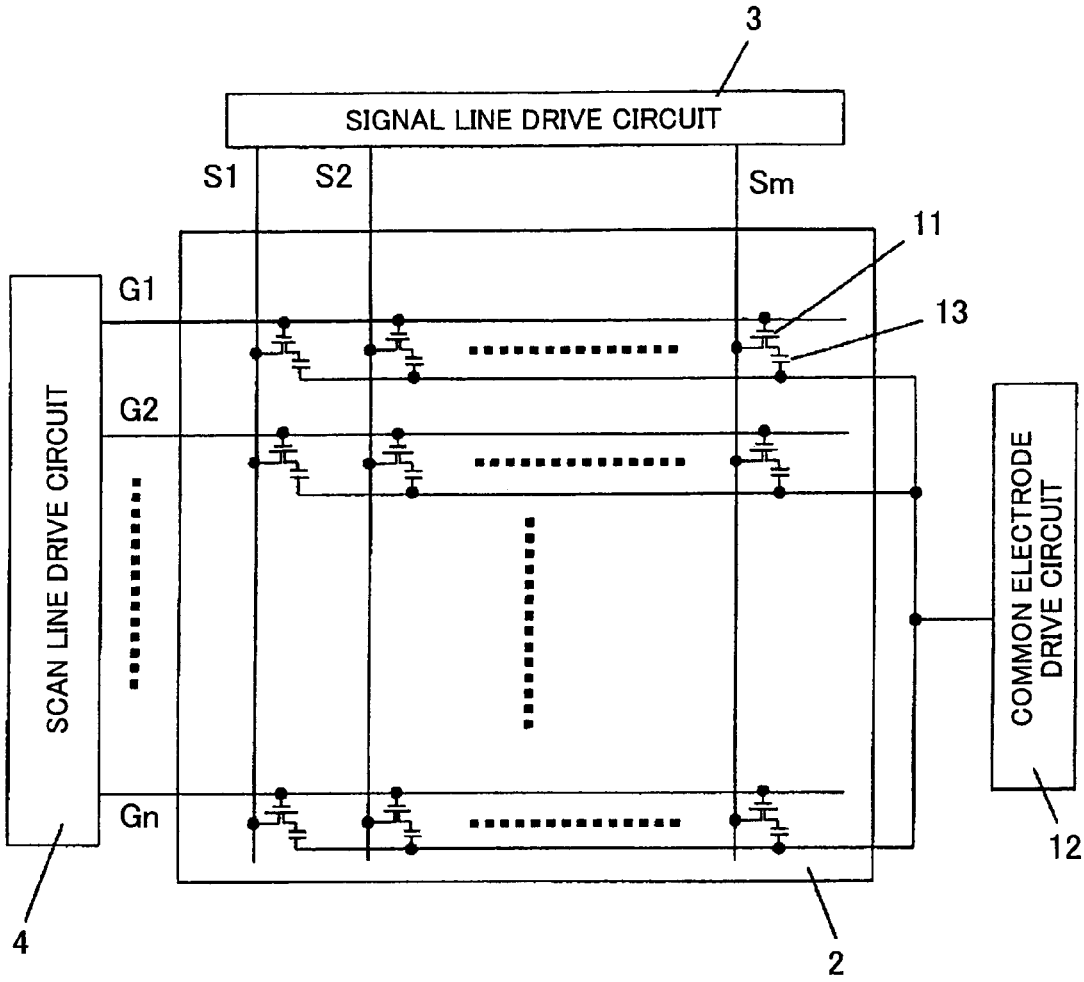
FIG. 11 is an explanatory diagram (equivalent circuit diagram) illustrating a schematic structure of the liquid crystal display panel.

With reference to FIGS. 8 and 9, described next is a second embodiment of the present invention. The same numbers are used for the same parts as the first embodiment of the present invention, and their explanations are omitted. FIG. 8 is a block diagram illustrating a schematic structure of the liquid crystal display according to the present embodiment. FIG. 9 is a summary table showing specific example of the reference gradation voltage data storage section in the liquid crystal display of the present embodiment.

As illustrated in FIG. 8, the liquid crystal display of the present embodiment has a temperature sensor 35, a reference gradation voltage data storage section 33, and a microcomputer 32. The temperature sensor 35 detects a temperature inside the display. The reference gradation voltage data storage section 33 is a ROM, for example, which stores plurality of values of the reference gradation voltages generated by the reference gradation voltage generation section 5, corresponding to the respective temperatures in the display and display methods (the impulse display mode and the hold display mode). The microcomputer 32 controls the LCD controller 21 to switch between the display methods (the impulse display mode and the hold display mode), based on the switching signal J1. The microcomputer 32 also selects and reads out any one of the sets of reference gradation voltage data stored in the reference gradation voltage data storage section 33, based on the switching signal J1 and in-device temperature data J2 detected by the temperature sensor 35.

As shown in FIG. 9, the reference gradation voltage data storage section 33 stores the sets of reference gradation voltage data corresponding to the hold display mode and the impulse display mode under respective temperature conditions, onto separate regions of a ROM. One of these sets of reference gradation voltage data is selected and output to the reference gradation voltage generation section 5, according to instructions from the microcomputer 32.

In consideration with the temperature dependency of the liquid crystal, reference gradation voltage data stored in the reference gradation voltage data storage section 33 is set so that gamma characteristics in the hold display mode is matched with those in the impulse display mode, in the following ranges of temperature; below 10 degrees, 10 to 20 degrees, 20 to 30 degrees, 30 to 40 degrees, 40 to 50 degrees, and above 50 degrees in Celsius, in a similar manner shown in the first embodiment. That is, when the number of display signal levels, that is, the number of display data is 256-gradation for eight bits, 12 sets of gradation voltage data corresponding to nine reference gradations for each a 32-step gradation, 0, 32, 64, 96, 128, 160, 192; 224, and 255, have been set and stored.

The temperature sensor 35 is preferably provided so as to detect a temperature of the liquid crystal display panel 2 itself as much as possible. A single or even a plurality of the temperature sensors 35 may be provided on inner surfaces of different panels. Also, the ranges of temperature for switching a reference gradation voltage are not limited to the above examples, and it is obvious that the ranges can be set as appropriate.

As described above, based on the switching signal J1 supplied to the microcomputer 22 and the detection signal J2 produced by the temperature sensor 35, any one of plural reference gradation voltage data is read out into the reference gradation voltage generation section 5. The plural reference gradation voltage data are stored on the reference gradation voltage storage section 33. Note that the plural reference gradation voltage data are used for carrying out the hold-type display or impulse-type display under each temperature condition. Then, based on the reference gradation voltage data thus read out, a gradation voltage to be applied to the liquid crystal display panel 2 is determined, corresponding to each gradation level of the input image data.

In this manner, under any temperature conditions and regardless of the type of display mode, it is possible to prevent changes in gamma characteristics caused by differences in response speed of the liquid crystal in each display gradation due to the insertion of the black display. Thus, a desirable display condition can be maintained, so that deterioration of display quality due to the changes in gamma characteristics can be prevented.

For simplicity of the explanation, in the above embodiment, the hold display mode in which a ratio of image display period in one field period (impulse ratio) is 100 percent and the impulse display mode in which the ratio is 50 percent can be selected alternatively. However, the present invention is not limited to this. Obviously, it is possible to control switching between a plurality of different impulse ratios by setting a suitable black display period. Thus, the arrangement allows a reference gradation voltage for driving the liquid crystal display panel to be varied, in accordance with each impulse ratio.

In the present embodiment, in accordance with a temperature in the display and whether the impulse-type display or the hold-type display to be performed, a reference gradation voltage for driving the liquid crystal display panel is varied. As a result, the gamma characteristics are always maintained at certain levels. However, the present invention is not limited to this. As an example, a gradation conversion section is provided in a stage prior to the LCD controller 21. Then, a gradation level of image data is converted, so that a gradation voltage to be applied to the liquid crystal display panel 2 can be varied according to the input image data.

Figure 17:
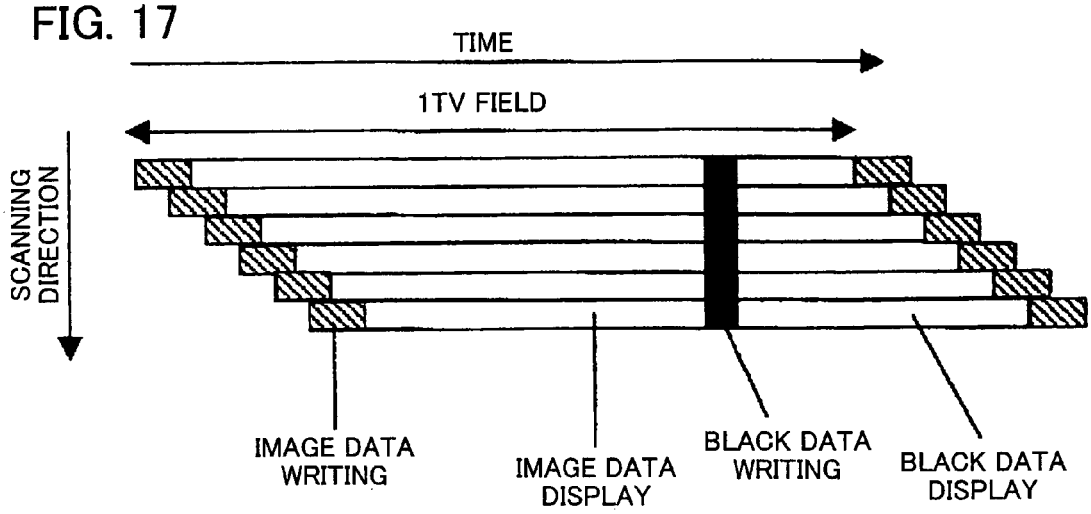
FIG. 17 is a schematic explanatory view illustrating the principle of display operation in the black-writing-type impulse display mode.
Figure 18:
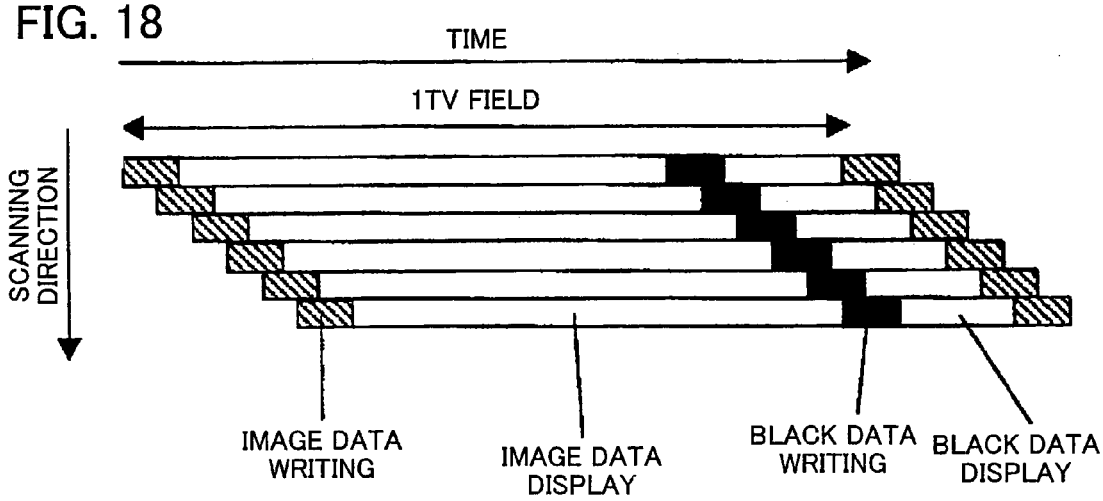
FIG. 18 is a schematic explanatory view illustrating the principle of display operation in the impulse display mode with another method of the black-writing type.
Figure 19:
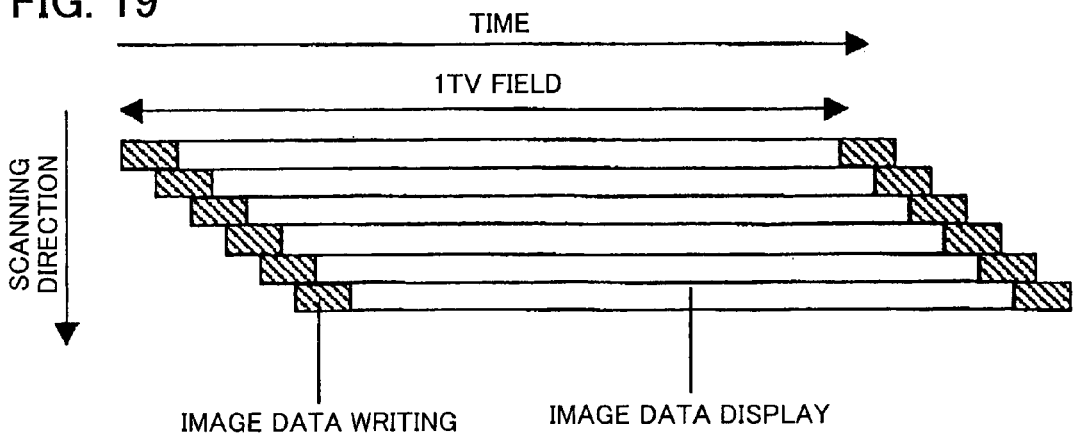
FIG. 19 is a schematic explanatory view illustrating the principle of display operation in the hold display mode.
Figure 20:
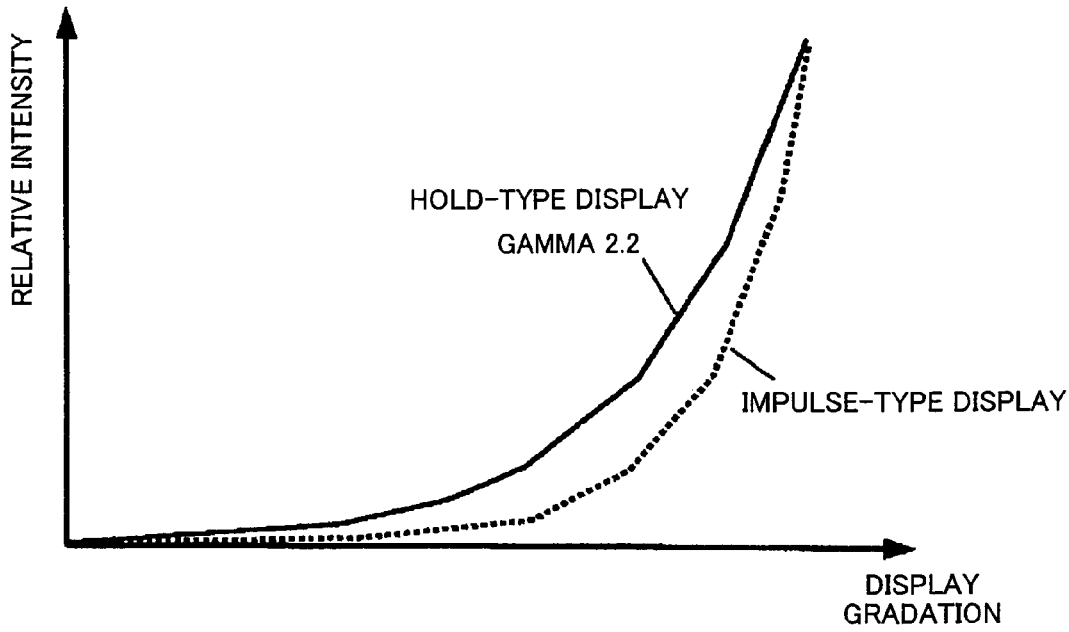
FIG. 20 is a schematic explanatory view expressing gamma characteristics in the hold display mode and the impulse display mode in the conventional liquid crystal display.
Figure 21:
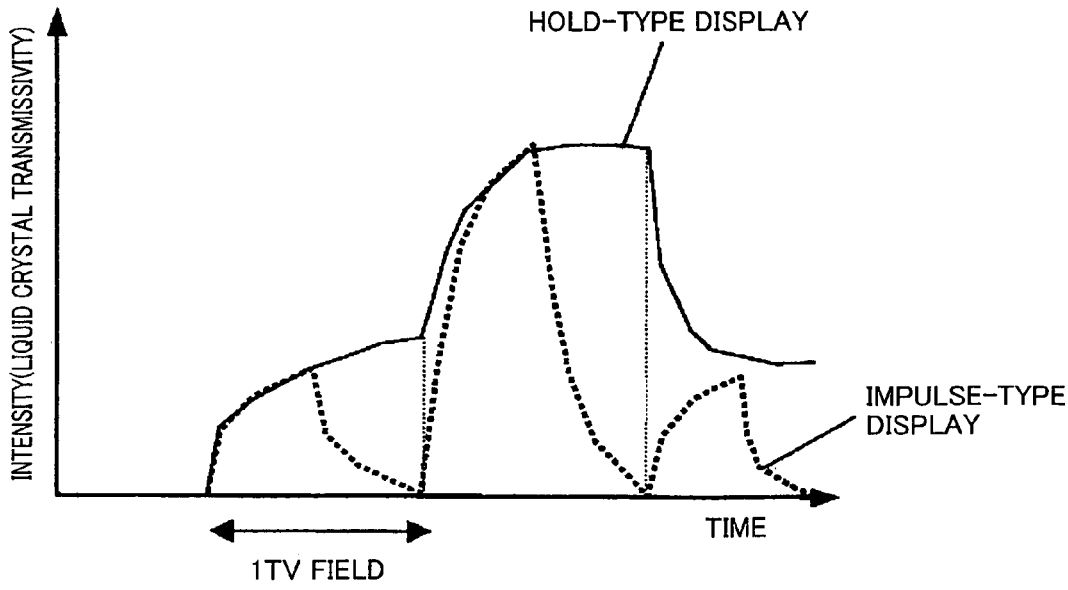
FIG. 21 is a schematic explanatory view expressing changes in display brightness with time in hold display mode and the impulse display mode in the conventional liquid crystal display.
Figure 22:
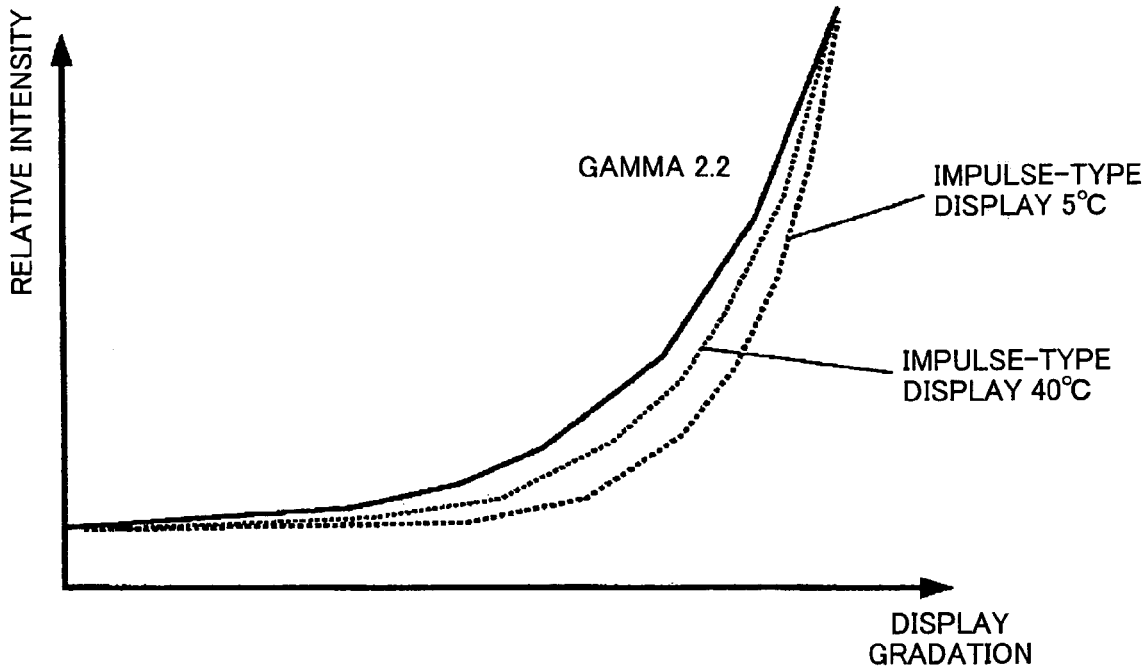
FIG. 22 is a schematic explanatory view expressing gamma characteristics in the impulse display mode under each temperature condition in the conventional liquid crystal display.

In the first and second embodiments, as shown in FIG. 18, descriptions are given about the impulse-type display carrying out the black display for a certain period of time in part of the screen. It is also possible to apply the above embodiments for the impulse-type display carrying out the black (or another single color) display over the entire screen for a certain period of time, as shown in FIG. 17. It is obvious that the timing for supplying the black display data to each of the scan lines of the liquid crystal display panel is not limited to the above.

As described above, the liquid crystal display of the present invention displays an image corresponding to input image data using the liquid crystal display panel, and has the following three means. The first means is to set, within one field period, an image display period for displaying input image data and a monochrome display period for displaying certain monochrome data. The second means is to switch the ratio of the image display period within one field period. The third means is to vary, in accordance with the ratio of the image display period within one field period, a gradation voltage to be applied to the liquid crystal display panel corresponding to the input image data.

In addition to the arrangement, the means for varying a gradation voltage may vary a reference gradation voltage for driving the liquid crystal display panel.

Furthermore, in addition to the arrangement, the liquid crystal display may have a storage section for storing a plurality of the reference gradation voltage data that is previously specified.

In addition to the arrangement, the liquid crystal display may have still other means for detecting a temperature in display, and means for varying a gradation voltage to be applied to the liquid crystal panel corresponding to input image data, in accordance with the detected in-device temperature.

In the liquid crystal display panel of the present embodiment, according to the ratio of the image display period within one field period, a gradation voltage to be applied to the liquid crystal display panel varies corresponding to input image data. Therefore, it is possible to prevent variation in gamma characteristics caused by differences in response speed of the liquid crystal between display gradations, when monochrome display is carried out. Thus, it is possible to prevent deterioration of display quality occurring when the impulse display mode and the hold display mode are switched, for example.

The reference gradation voltage for driving the liquid crystal display panel can be varied according to the ratio of the image display period within one field period. Therefore, display performance of the liquid crystal display panel can be maintained, so that high-quality display can be realized. Further, by preventing differences in gamma characteristics due to the temperature dependency of the liquid crystal, high-quality display can be always achieved.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

In the liquid crystal display of the present invention, in accordance with a selected drive mode (impulse drive mode or hold drive mode), a gradation voltage to be applied to the liquid crystal display panel varies corresponding to input image data. Therefore, it is possible to prevent variation in gamma characteristics, which is caused by differences in response speed of the liquid crystal between display gradations, when monochrome display is carried out in the impulse drive mode. Thus, high-quality display can be realized, so that the liquid crystal display can be suitably used for various types of devices including liquid crystal TV sets.

The invention claimed is:

1. A liquid crystal display displaying, using a liquid crystal display panel, an image responsive to input image data, comprising:

a driving device that drives the liquid crystal display panel in either an impulse drive mode or a hold drive mode, (i) the impulse drive mode having an image display period for performing display of the input image data and a monochrome display period for performing display of certain previously-specified monochrome display data, each of the display periods being performed within an input image data rewriting period, the input image data and the monochrome display data written sequentially in each of scan lines of the liquid crystal display panel and written in each pixel of the liquid crystal display panel, (ii) the hold drive mode performing display of the input image data for the entire rewriting period, without setting the monochrome display period, the image data written sequentially in each of scan lines of the liquid crystal display panel and written in each pixel of the liquid crystal display panel;

a switching device that switches between the modes for driving the liquid crystal display panel by the driving means; and a voltage varying device that varies, in accordance with the input image data and according to one of the modes for driving the liquid crystal display panel, a gradation voltage applied to the liquid crystal display panel and corresponding to the image data, so as to prevent changes in gamma characteristics due to differences in response speed of liquid crystal between display gradations, which differences are caused by insertion of the monochrome display data.

2. The liquid crystal display of claim 1, wherein the voltage varying device varies a reference gradation voltage for driving the liquid crystal display panel.

3. The liquid crystal display of claim 2, further comprising:

a storage section storing sets of reference gradation voltage data previously specified.

4. The liquid crystal display of any one of claims 1, 2, or 3, further comprising:

a temperature detecting device that detects a temperature in the liquid crystal display; and wherein the voltage varying device varies the level of the gradation voltage to be applied to the liquid crystal display panel, in accordance with the input image data and the detected temperature in the display.

5. The liquid crystal display of any one of claims 1, 2, or 3, wherein the switching device switches between the modes for driving the liquid crystal display panel in accordance with a user's instruction.

6. A liquid crystal display displaying, using a liquid crystal display panel, an image responsive to input image data, comprising:

a driving device that drives the liquid crystal display panel switchably in either an impulse drive mode or a hold drive mode, (i) the impulse drive mode having an image display period for performing display of the input image data and a monochrome display period for performing display of certain previously-specified monochrome display data, each of the display periods being performed within an input image data rewriting period, the input image data and the monochrome display data written sequentially in each of scan lines of the liquid crystal display panel and written in each pixel of the liquid crystal display panel, (ii) the hold drive mode performing display of the input image data for the entire rewriting period, without setting the monochrome display period;

a switching device that switches between the modes for driving the liquid crystal display panel by the driving means; and a voltage varying device that varies, in accordance with the input image data and according to one of the modes for driving the liquid crystal display panel, a gradation voltage applied to the liquid crystal display panel and corresponding to the image data, so that a relationship between a display gradation of the image and an integral of display transmittance of the image within the input image data rewriting period, in a case where the driving device drives the liquid crystal display panel in the impulse drive mode, is equal to a relationship between the display gradation of the image and the display transmittance of the image in a case where the driving device drives the liquid crystal display panel in the hold drive mode.

* * * * *